US011081819B2

(12) United States Patent
Xu et al.

(10) Patent No.: US 11,081,819 B2
(45) Date of Patent: Aug. 3, 2021

(54) ELECTRICAL CONNECTOR USING A METALLIC SLIDING BLOCK TO HOLD AN INNER INSULATOR DURING THE OVERMOLDING OF AN OUTER INSULATOR ONTO THE INNER INSULATOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yin-Chao Xu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/368,863

(22) Filed: Mar. 29, 2019

(65) Prior Publication Data

US 2019/0305452 A1 Oct. 3, 2019

(30) Foreign Application Priority Data

Mar. 29, 2018 (CN) ..... 201810272218.0

(51) Int. Cl.
*H01R 13/504* (2006.01)
*H01R 43/24* (2006.01)
(Continued)

(52) U.S. Cl.
CPC ..... *H01R 12/7005* (2013.01); *H01R 12/71* (2013.01); *H01R 13/40* (2013.01);
(Continued)

(58) Field of Classification Search
CPC .. H01R 12/724; H01R 13/502; H01R 13/504; H01R 13/514; H01R 43/24;
(Continued)

(56) References Cited

U.S. PATENT DOCUMENTS 6,210,218 B1 * 4/2001 Chang ..... H01R 12/7029 439/567
7,275,955 B2 * 10/2007 Ko ..... H01R 12/592 439/498
(Continued)

FOREIGN PATENT DOCUMENTS

CN 2874816 Y 2/2007
CN 104283035 B 7/2017

*Primary Examiner* — Vanessa Girardi
(74) *Attorney, Agent, or Firm* — Ming Chieh Chang; Wei Te Chung

(57) ABSTRACT

An electrical connector includes an insulative housing having a first insulator integrally formed with the contacts via an insert-molding process, and a second insulator, i.e., the cover, overmolded upon the first insulator wherein an internal cavity is formed within the housing and between the first insulator and the second insulator in the transverse direction, through which a sliding block presses the first insulator in position in the transverse direction during overmolding the second insulator.

11 Claims, 16 Drawing Sheets

(51) Int. Cl.

| | |
|---|---|
| ***H01R 12/70*** | (2011.01) |
| ***H01R 12/71*** | (2011.01) |
| ***H01R 13/40*** | (2006.01) |
| ***H01R 13/6582*** | (2011.01) |
| ***H01R 43/20*** | (2006.01) |
| ***H01R 24/62*** | (2011.01) |

(52) U.S. Cl.
CPC ..... *H01R 13/504* (2013.01); *H01R 13/6582* (2013.01); *H01R 24/62* (2013.01); *H01R 43/205* (2013.01); *H01R 43/24* (2013.01)

(58) Field of Classification Search
CPC .... H01R 12/7005; H01R 12/71; H01R 13/40; H01R 13/6582; H01R 43/205; H01R 24/62
See application file for complete search history.

(56) References Cited

U.S. PATENT DOCUMENTS

| | | | | |
|---|---|---|---|---|
| 9,231,319 | B2 * | 1/2016 | Qian | H01R 13/504 |
| 9,520,683 | B2 * | 12/2016 | Qian | B29C 45/14467 |
| 2019/0296476 | A1 * | 9/2019 | Xu | H01R 12/724 |

* cited by examiner

ELECTRICAL CONNECTOR USING A METALLIC SLIDING BLOCK TO HOLD AN INNER INSULATOR DURING THE OVERMOLDING OF AN OUTER INSULATOR ONTO THE INNER INSULATOR

BACKGROUND OF THE INVENTION

1. Field of the Invention

The present invention relates generally to an electrical connector, and more particularly to the electrical connector having a contact module embedded within a single piece overmolded cover via assistance of an internal cavity which is hidden after the connector is mounted upon a printed circuit board.

2. Description of Related Arts

U.S. Pat. No. 9,231,319 discloses an electrical connector provided with a metallic shell receiving a contact module therein while exposing the contacting sections of the contacts to an exterior. Because the gap between the shell and the contact module is inevitable that may jeopardize the mechanical and electrical performance of the connector, an insulative over-molding cover applied upon the contact module without any gap therebetween is an approach. Anyhow, a single over-molding cover to circumferentially cover the contact module may result in an uneven exterior surface thereof with a not good-looking appearance due to the positioning/core pins which are used to hold the contact module in position along the mold moving direction during the over-molded procedure.

An electrical connector with no gap between the shell and the contact module and a good-looking appearance thereof is desired.

SUMMARY OF THE INVENTION

An object of the invention is to provide an electrical connector with a contact module enclosed within a single overmolded cover. The electrical connector includes an insulative housing and a plurality of contacts retained in the housing. The housing includes a base and a tongue extending upwardly from the base. The tongue forms a first mating surface and a second mating surface opposite to each other in a transverse direction. Each contact includes a contacting section exposed up on the first mating surface, a tail section exposed outside of the base, and retaining section between the contacting section and the tail section in a vertical direction perpendicular to the transverse direction. The housing includes a first insulator integrally formed with the contacts via an insert-molding process, and a second insulator, i.e., the cover, overmolded upon the first insulator wherein an internal cavity is formed within the housing, through which a sliding block presses the first insulator in position in the transverse direction during overmolding the second insulator. The internal cavity is hidden from an exterior upwardly or horizontally but extending through a bottom face of the housing to confront a printed circuit board on which the connector is mounted. Understandably, the internal cavity may be optionally filled with another insulator after the second insulator is formed, if desired.

DETAILED DESCRIPTION OF THE PREFERRED EMBODIMENT

Figure 1:
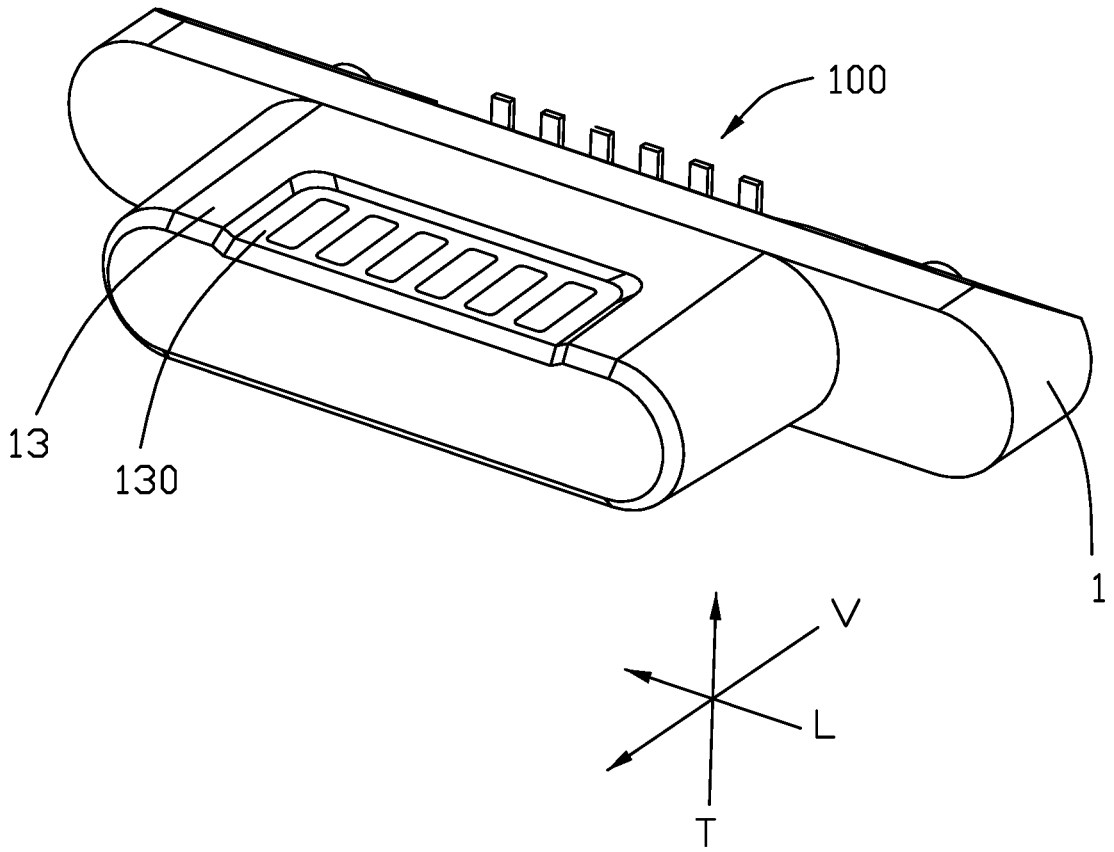
FIG. 1 is a perspective view of an electrical connector according to a first embodiment of the present invention.
Figure 2:
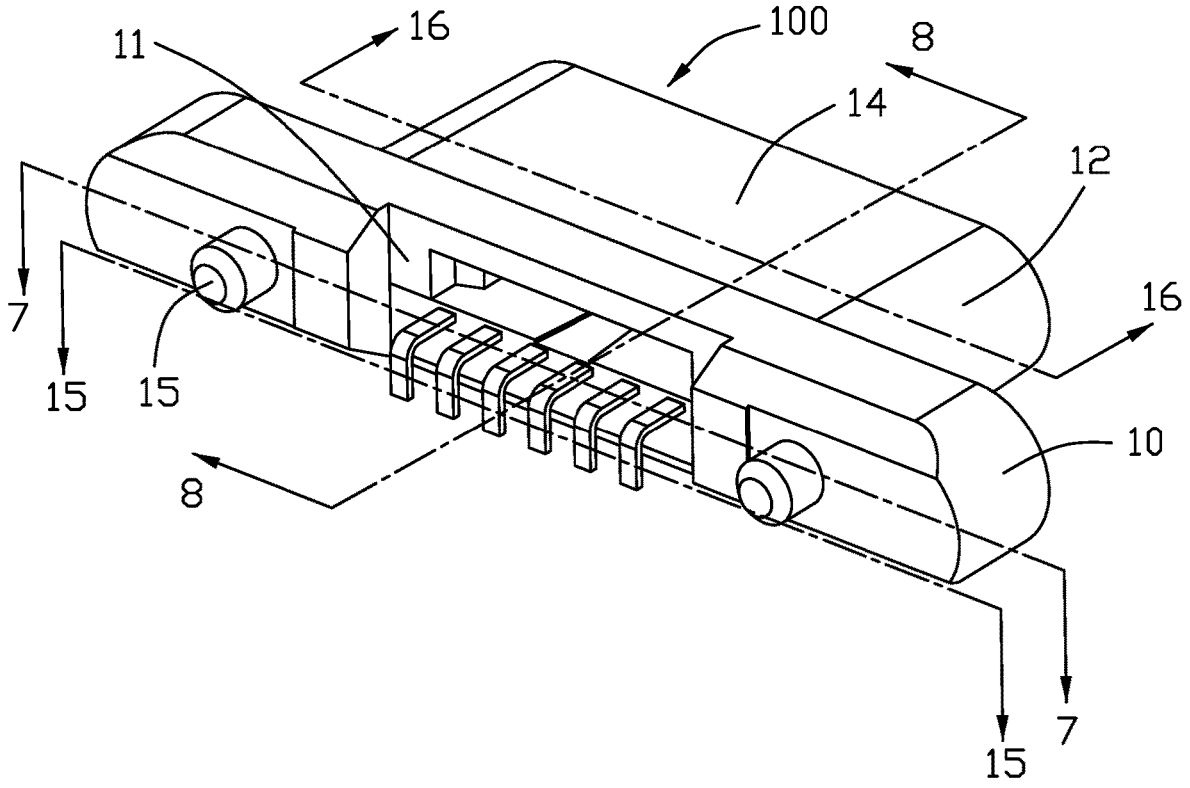
FIG. 2 is another perspective view of the electrical connector of FIG. 1.
Figure 3:
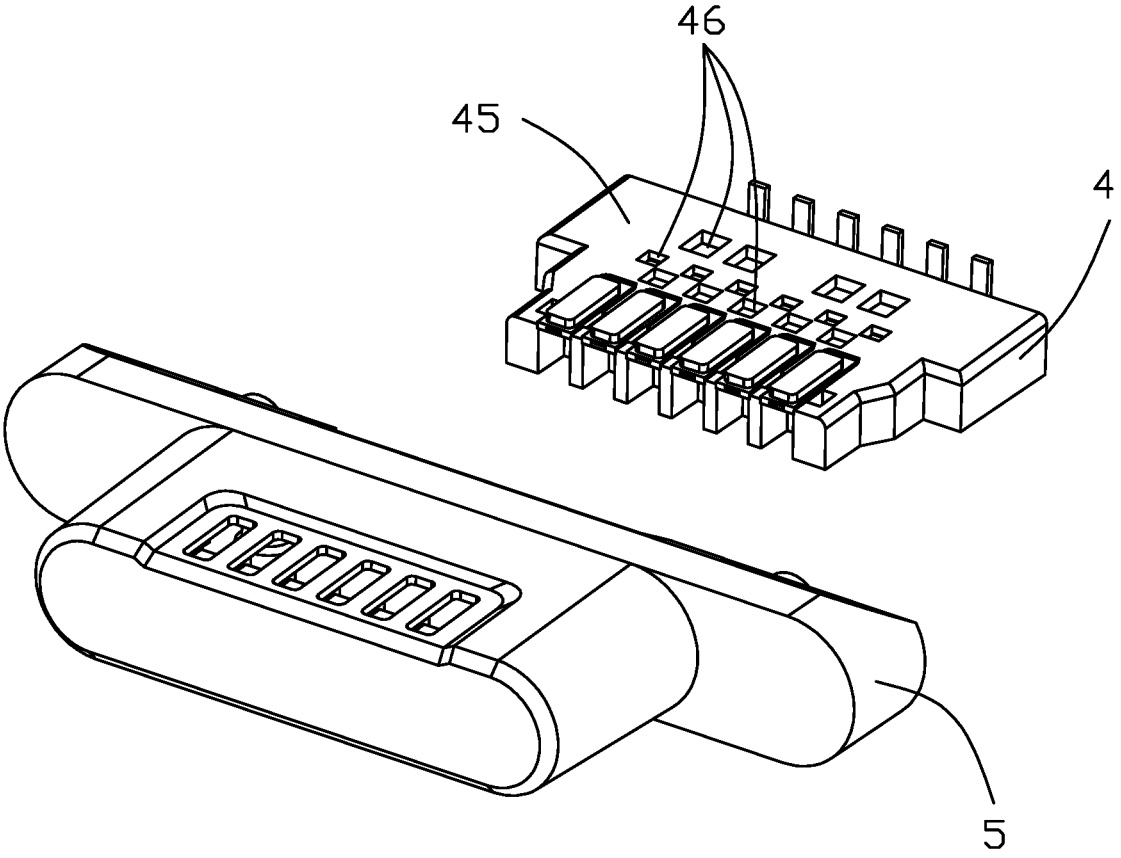
FIG. 3 is an exploded perspective view of the electrical connector of FIG. 1 before the cover is over-molded upon the contact module.
Figure 4:
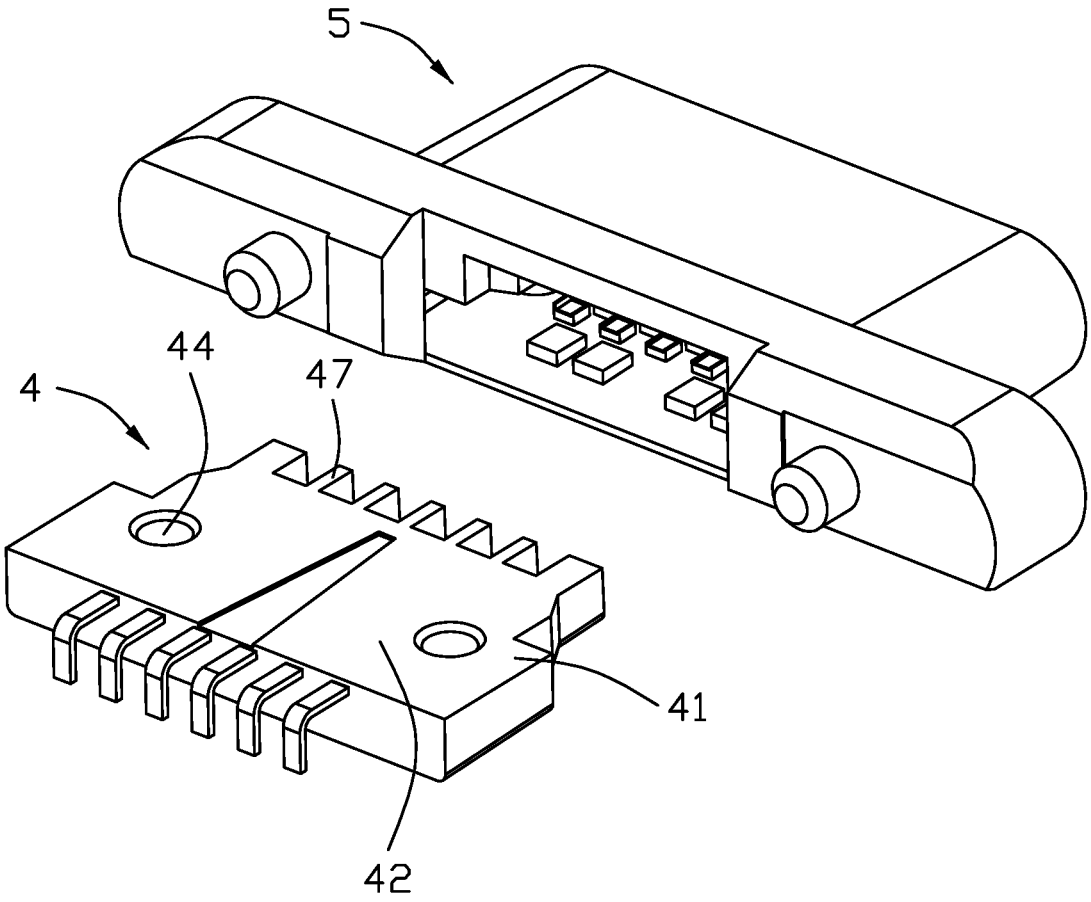
FIG. 4 is another exploded perspective view of the electrical connector of FIG. 3.
Figure 5:
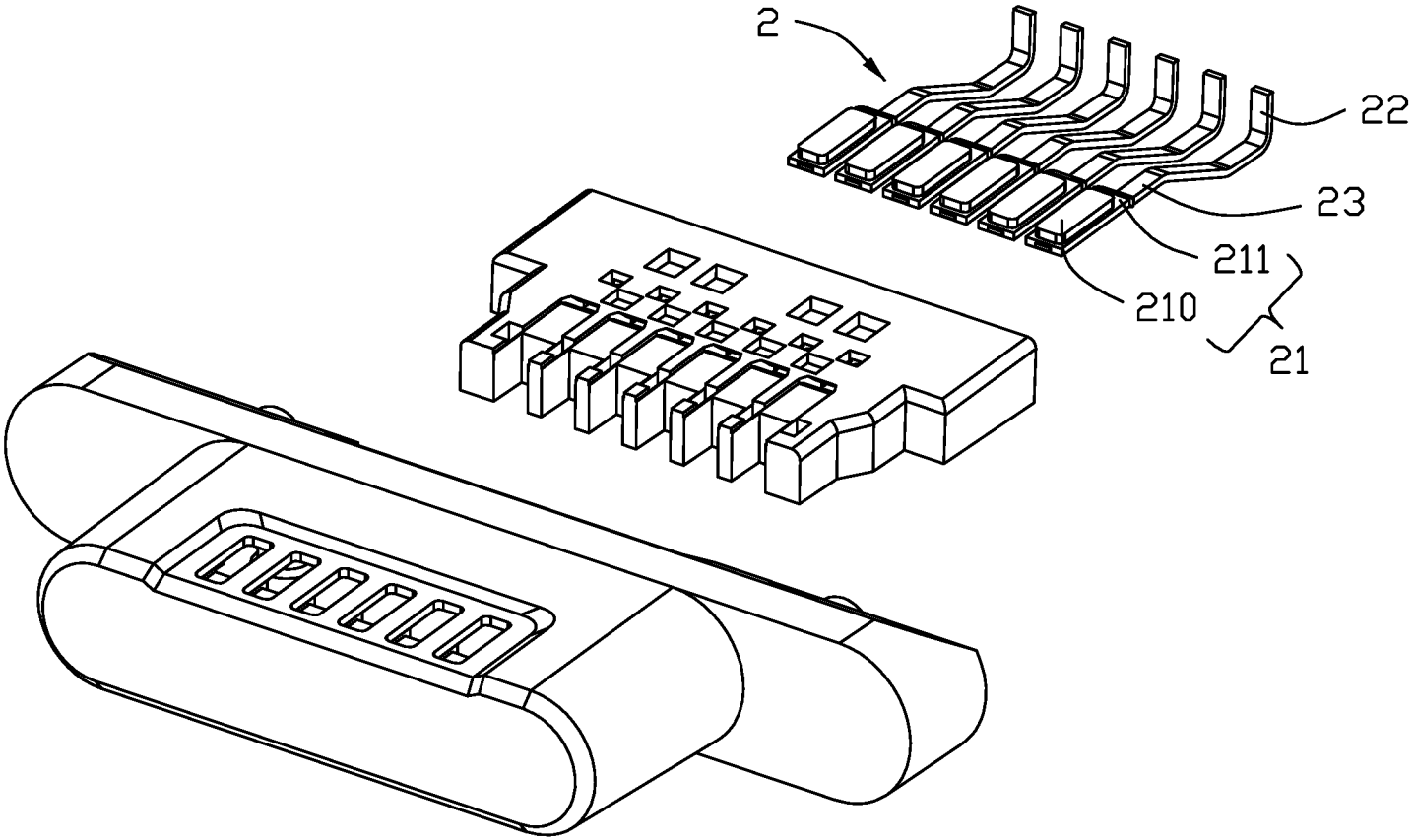
FIG. 5 is a further exploded perspective view of the electrical connector of FIG. 3 wherein the contacts are removed from the first insulator.
Figure 6:
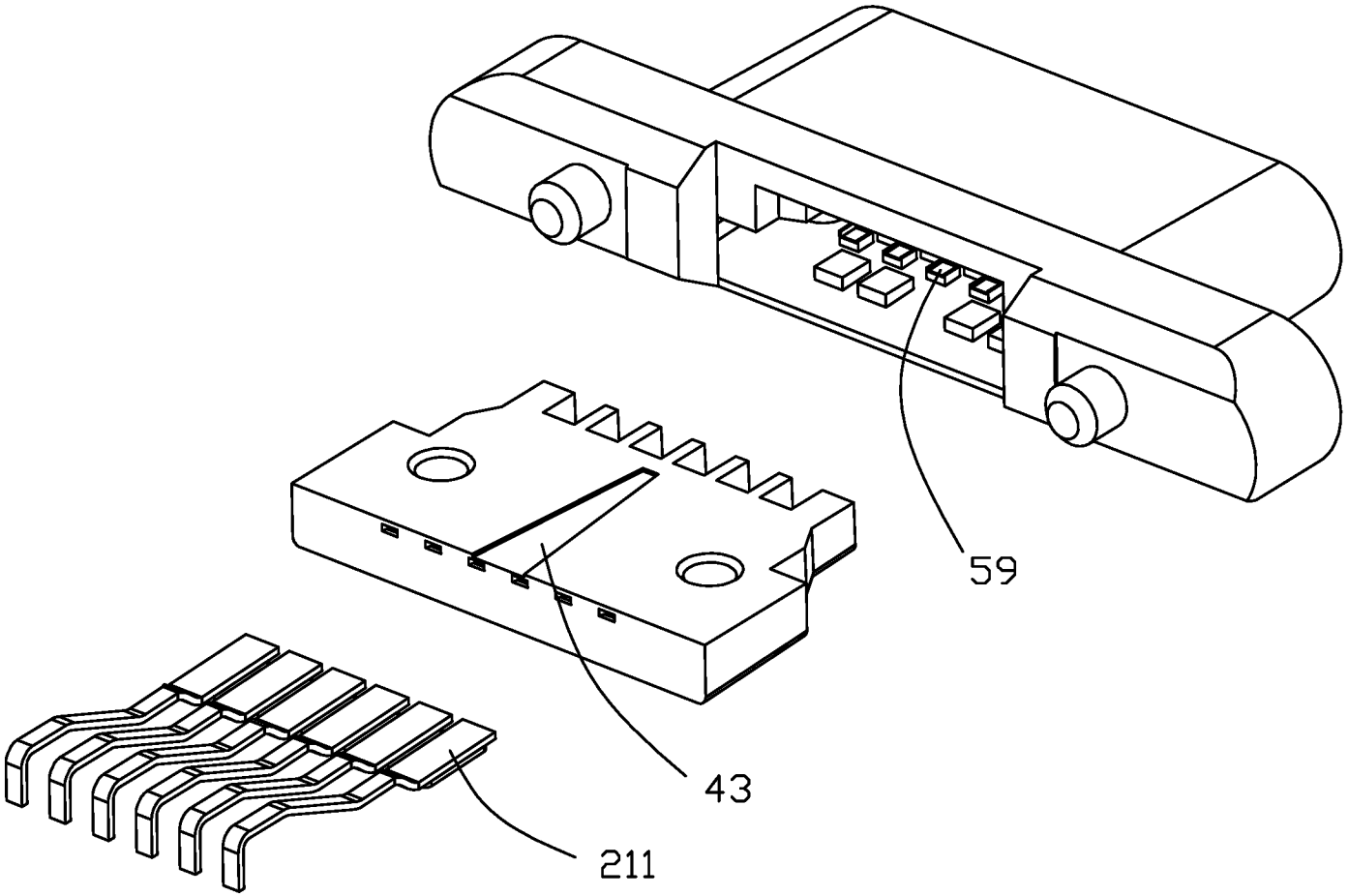
FIG. 6 another exploded perspective view of the electrical connector of FIG. 5.

Referring to FIGS. 1-8, an electrical connector 100 includes an insulative housing 1 and one row of contacts 2. The housing 1 includes a base 10 a tongue 12 extending upwardly from the base 10 in a vertical direction V, and pair of posts downwardly extending from the base 10 in the vertical direction. The tongue 12 forms a first mating surface 13 and a second mating surface 14 opposite to each other in a transverse direction T perpendicular to the vertical direction V. The contacting 2 includes the front contacting section 21 exposed upon the first mating surface 13, a tail section 22 exposed outside of the base 10, and a retaining section 23 linked between the contacting section 21 and the tail section 22 along the vertical direction V and retained in the housing 1 while the row of contacts 2 are spanned to be spaced from one another in a longitudinal direction L of the housing 1 which is perpendicular to both the vertical direction V and the transverse direction T. The contacting section 21 includes an outer platform 210 for contacting the mating connector, and an inner locating section 211 connected to the retaining section 23. The housing 1 is integrally formed with the contacts 2. A downwardly extending internal cavity 3 is formed in the housing 1 for maintaining the smooth and complete plane on the first mating surface 13 and the second surface 14.

The first mating surface 13 forms a contact mating area 130 on which the contacting sections 21 of the contacts 2 are exposed while the second mating surface 14 has no contact mating area thereon.

The insulative housing 1 includes a first/inner insulator 4 integrally formed with the contacts 2 via an insert-molding process initially to form a contact module, and a second/outer insulator or an outer cover 5 applied upon the first insulator 4 via an overmolding process successively. The first insulator 4 includes a pair of wings 41. The first insulator 4 forms first face 42 and a second face 45 opposite to each other in the transverse direction T wherein the first face 42 communicatively faces the internal cavity 3 with a positioning groove 43 therein. The positioning groove 43 extends upwardly in a bottom end of the first face 41 and is terminated before reach the upper end thereof. A pair of sink holes 44 are formed in the first face 42, and a plurality of positioning holes 46 are formed in the second face 45 to communicate with the corresponding contacts 2 for assisting holding the contacts 2 during the insert-molding process. Notably, such positioning holes 46 may be filled with protrusions 59 of the outer insulator 5 during the overmolding process. The internal cavity 3 further is equipped with a pair of tapered grooves 30 for facilitating removal of the sliding block, which is used to hold the contact module in position during the overmolding process so as to form the internal cavity 3 after the overmolding process.

The first insulator 4 includes a plurality of dividers 47 for separating the contacting sections 21 of the contacts 2 from one another along the longitudinal direction L. The locating section 211 is located upon the second face 45 and between the neighboring dividers 47.

A bottom face of the base 10 forms a cutout 11 to expose the first insulator 4. In this embodiment, the internal cavity 3 is longer than the first insulator 4 in the vertical direction V while is narrower in the longitudinal direction L. Notably, the second insulator or the outer cover 5 will occupy the sink holes 44, the space between every adjacent two dividers 47, and the positioning holes 46 during the overmolding process for enhancing retention between the first insulator 4 and the second insulator 5.

As shown in FIGS. 9-12, in the second embodiment, the electrical connector 100' includes an insulative housing 1' and a plurality of contacts 2' retained therein wherein three internal cavities 3' replace the unitary internal cavity 3 of the first embodiment so as to form the partitions 6' between every adjacent two internal cavities 3' for enhancing the structure thereof.

Figure 13:
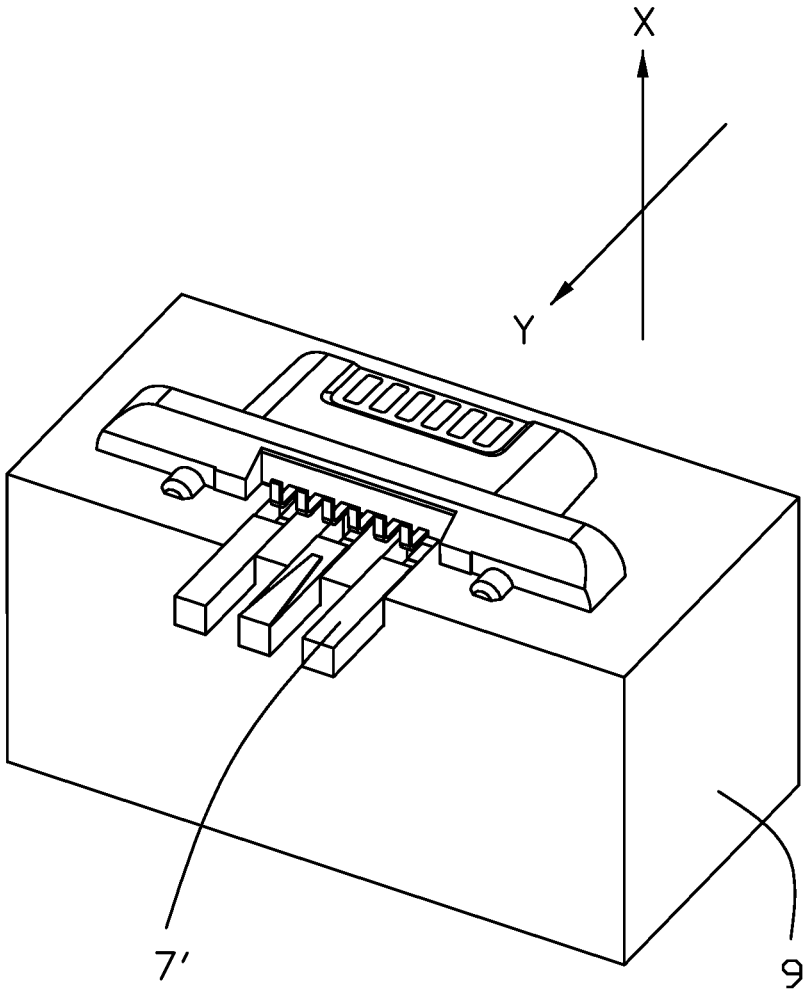
FIG. 13 is a perspective view of the electrical connector of FIG. 9 retained in a half mold associated with the corresponding sliding blocks during the overmolding process.
Figure 14:
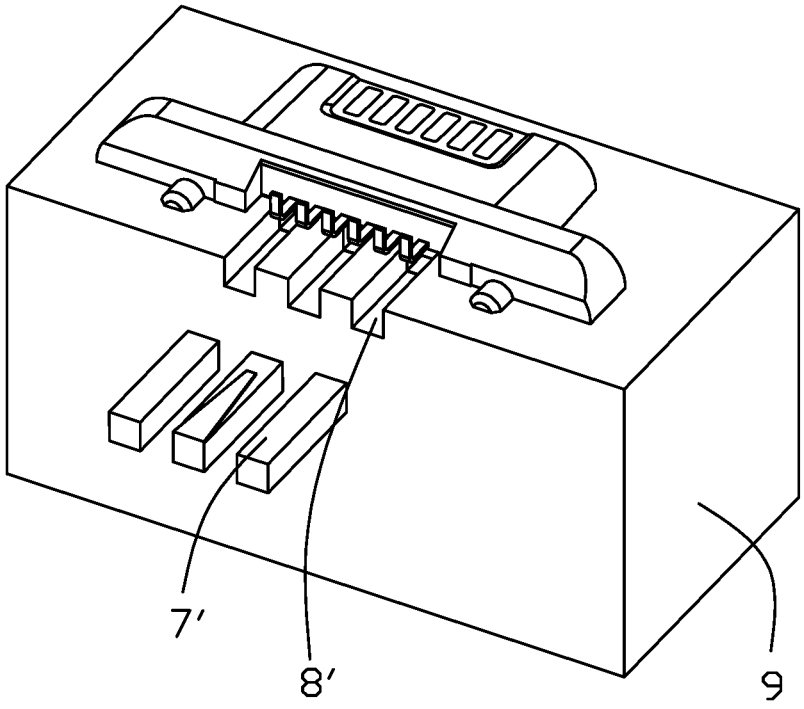
FIG. 14 is a perspective view of the electrical connector and the half mold and the corresponding sliding blocks of FIG. 13 wherein the sliding blocks are fully withdrawn from the housing and the half mold.

As shown in FIGS. 13 and 14, the manufacturing method of the second embodiment includes the following steps. Firstly, a plurality of contacts are integrally formed within a first insulator via an insert-molding process to form a contact module wherein a positioning groove 43' is formed on the first insulator 4'. Secondly, the contact module is positioned into a pair of molds 9' (only one shown), which are operated along the direction X, and three sliding blocks 7' are moveably received within the corresponding sliding slots 8' in the mold 9' and used to press against the first insulator 4' of the contact module so as to cooperate with the other mold (not shown) for holding the contact module in position. Thirdly, the second insulator 5 is applied upon the contact module to form the complete connector via an overmolding process. Fourthly, the sliding blocks 7' and the molds 9' are removed from the electrical connector 1' wherein the internal cavity 3' is formed due to the sliding block 7'.

Figure 7:
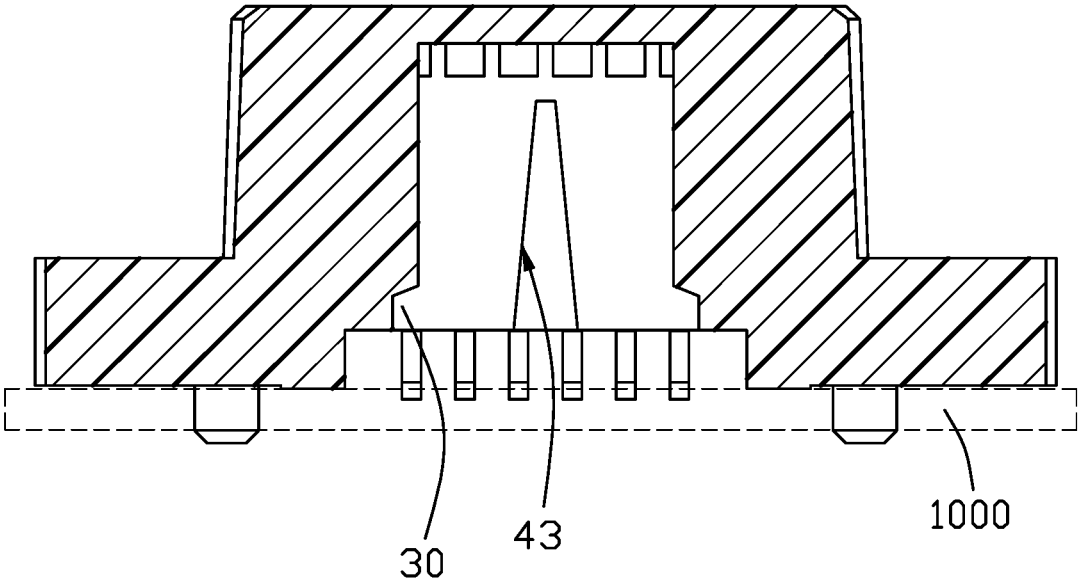
FIG. 7 is a cross-sectional view of the electrical connector of FIG. 1 along line 7-7 to show how the positioning groove in the first insulator.
Figure 8:
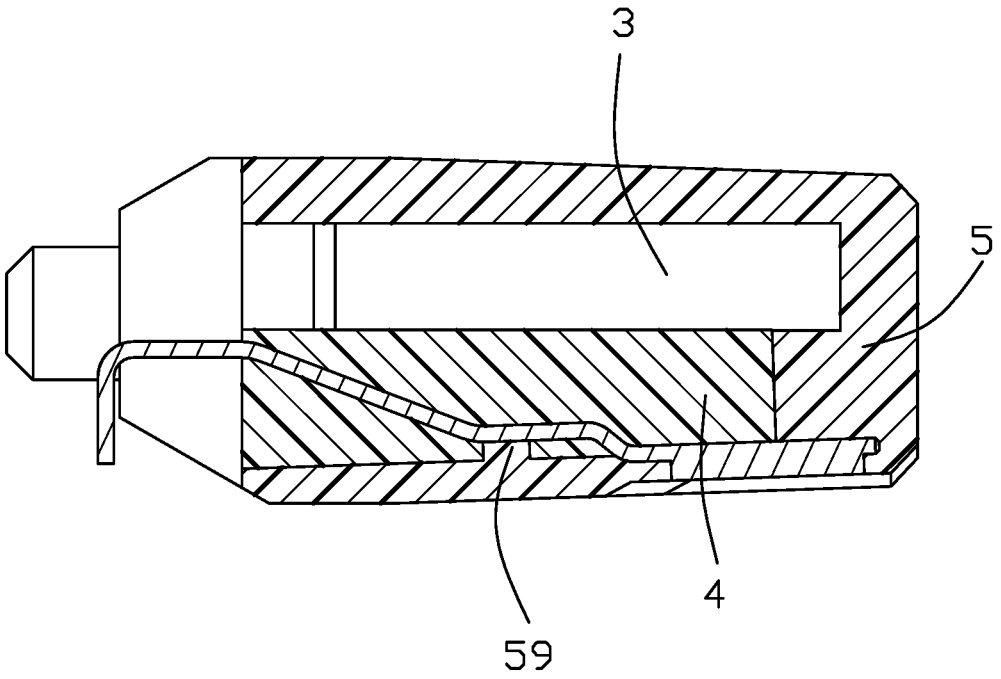
FIG. 8 is another cross-sectional view of the electrical connector of FIG. 2 along line 8-8 to show how the internal cavity is formed in the housing.
Figure 9:
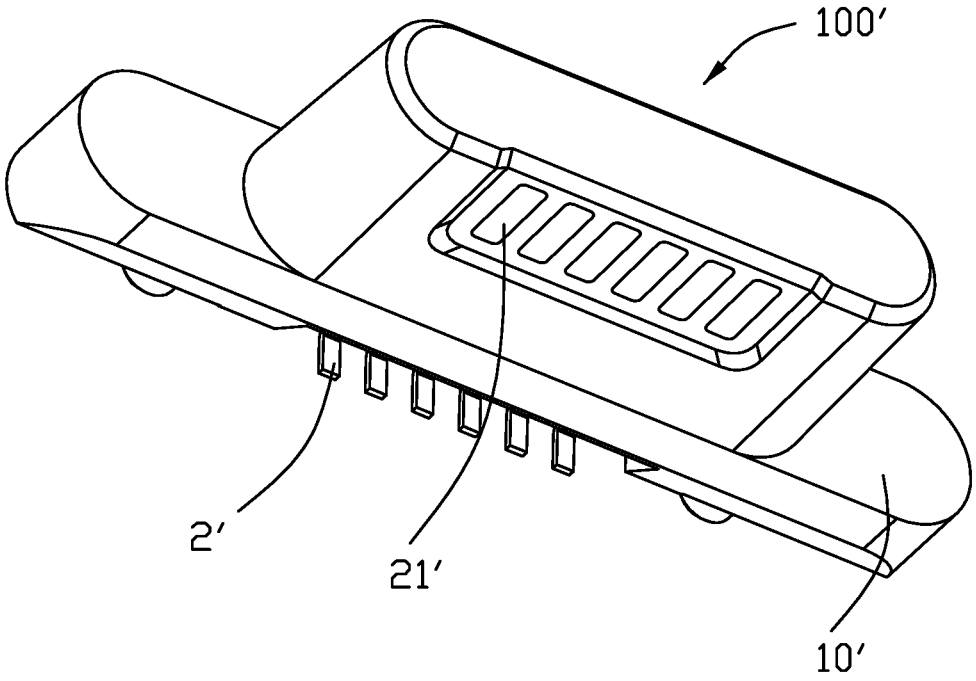
FIG. 9 is a perspective view of the electrical connector according to a second embodiment of the invention.
Figure 10:
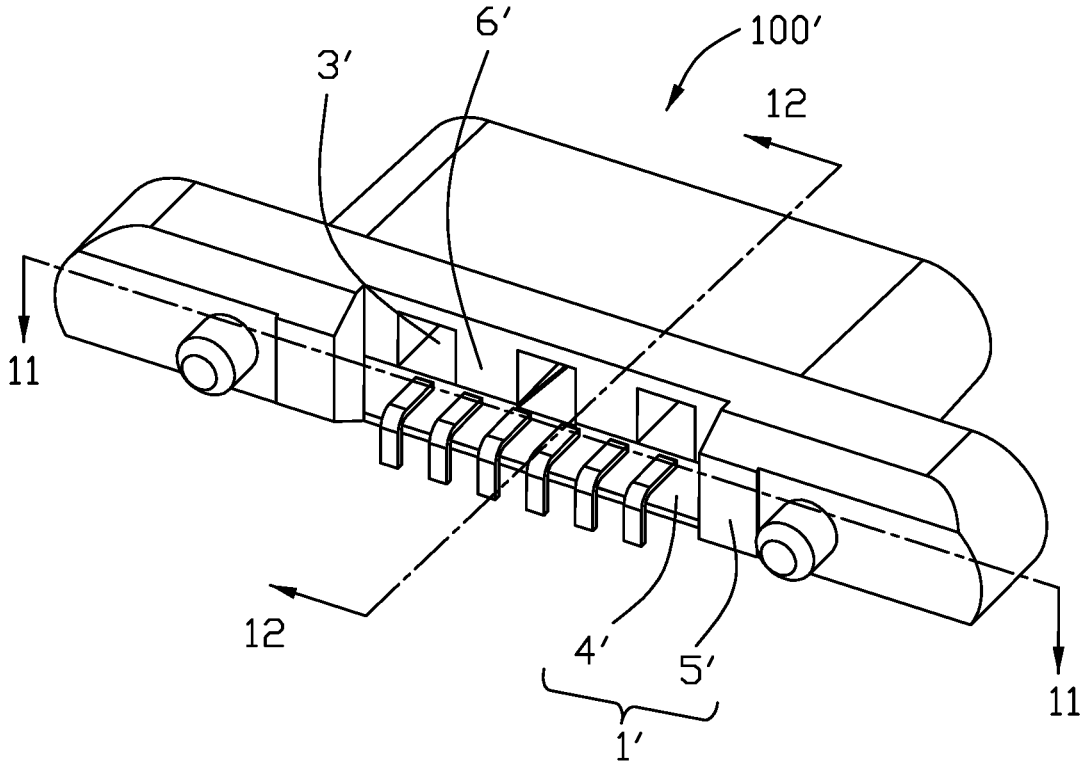
FIG. 10 is another perspective view of the electrical connector of FIG. 9.
Figure 11:
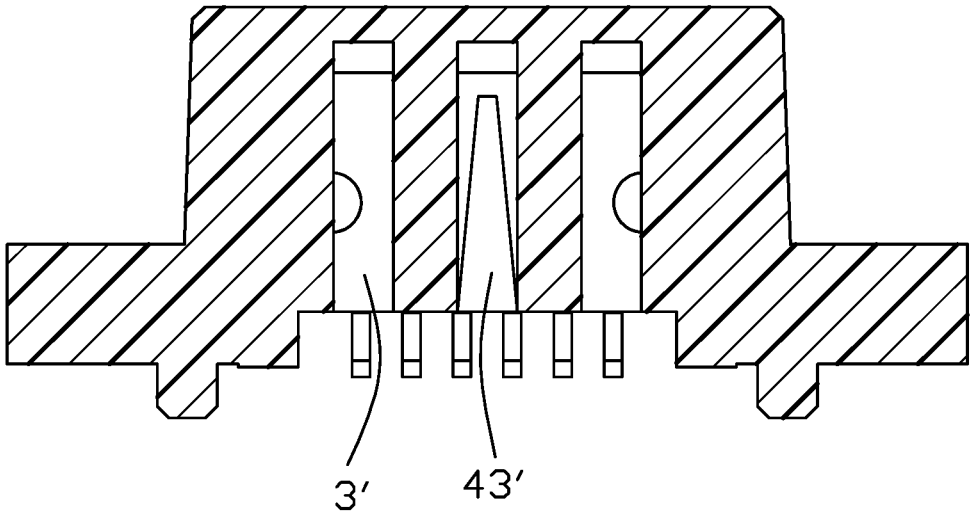
FIG. 11 is a cross-sectional view of the electrical connector of FIG. 10 along line 11-11 to show how the internal cavities are formed in the housing.
Figure 12:
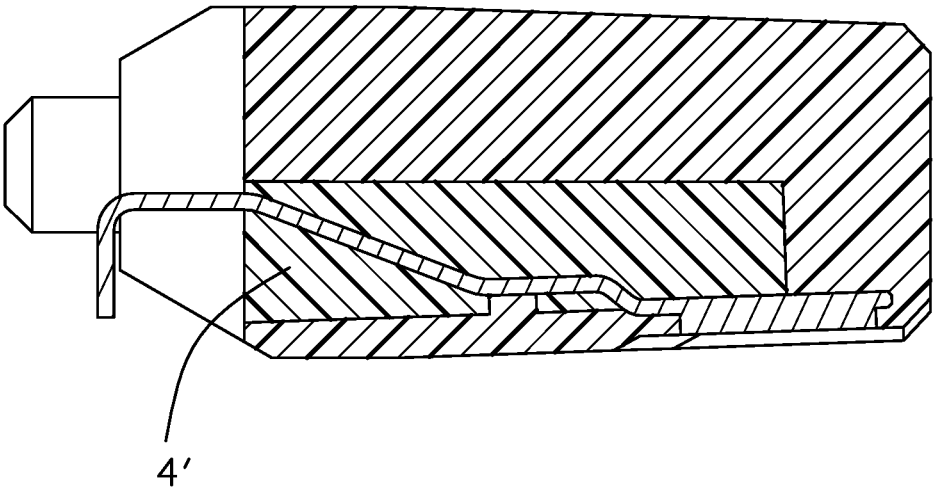
FIG. 12 is another cross-sectional view of the electrical connector of FIG. 10 along line 12-12 to show how the contact module is retained in the housing.
Figure 15:
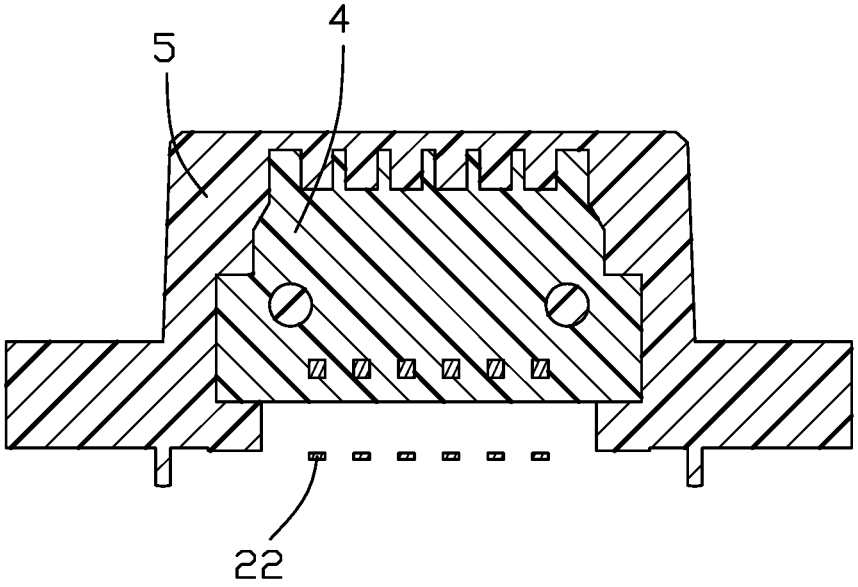
FIG. 15 is a cross-sectional view of the electrical connector of FIG. 2 along line 15-15 to show how the contact module is retained in the cover.
Figure 16:
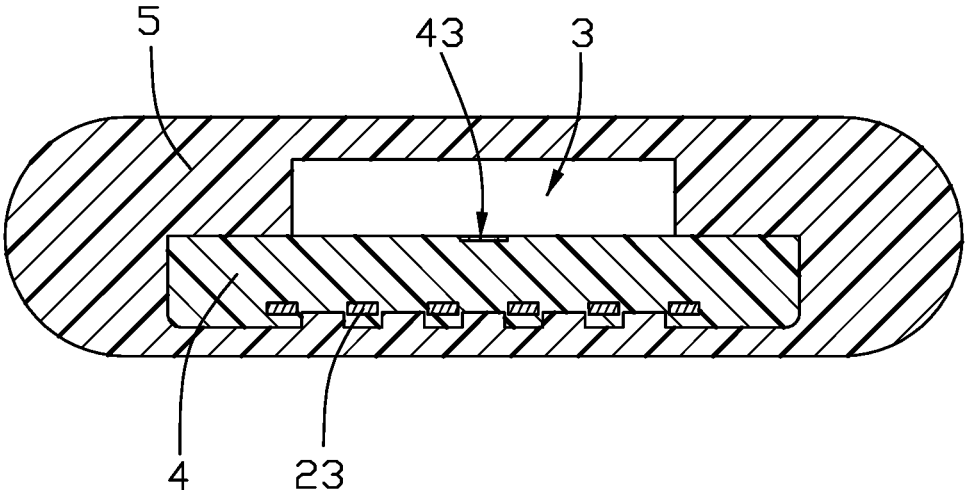
FIG. 16 is another cross-sectional view of the electrical connector of FIG. 2 along line 16-16 to show the structural relation among the contact module, the outer cover and the internal cavity, viewed along the vertical direction.

As shown in FIG. 16, the invention is to provide an electrical connector with a contact module enclosed within a single outer cover via a single overmolding process via assistance of an internal cavity which receives a sliding block during the overmolding process, wherein the contacting sections of the contacts of the contact module are exposed upon only one mating surface. Notably, such an internal cavity only downward faces a printed circuit board 1000 on which the connector is mounted, as shown in FIG. 7, in a hidden manner, thus not jeopardizing the appearance of the connector itself. As shown in FIG. 15, the inner insulator 4 of the contact module is essentially circumferentially, along all the vertical direction V, the transverse direction T and the longitudinal direction L, retained by the outer insulator 5 except the bottom end and the contacting sections on the mating area, thus assuring a good-looking appearance of the whole connector. Notably, as shown in FIG. 8, on one hand the inner insulator 4 is located, in the transverse direction, between the internal cavity 3 and one mating surface 13 where the contacting sections 21 are exposed to the exterior; on the other hand, the internal cavity 3 is located, in the transverse direction, between the inner insulator 4 and another mating surface 14.

What is claimed is:

1. An electrical connector comprising:

a contact module including a plurality of contacts integrally formed within an inner insulator via an insert-molding process, said contacts being arranged in one row along a longitudinal direction, each of said contacts including an upper contacting section, a lower tail section and a middle retaining section therebetween in a vertical direction perpendicular to the longitudinal direction wherein the contacting section is planar and immovable, and directly exposed to an exterior outside of the electrical connector in a transverse direction perpendicular to both the longitudinal direction and the vertical direction; and an outer insulator applied upon the contact module via a single overmolding process to retain the contact module circumferentially along all the vertical direction, the longitudinal direction and the transverse direction, except a bottom end of the contact module which is adapted to face downward, in the vertical direction, toward a printed circuit board on which the electrical connector is adapted to be mounted, and the contacting sections which are exposed to said exterior in the transverse direction; wherein an internal cavity is formed between the inner insulator and the outer insulator in the transverse direction and downward faces toward said exterior in the vertical direction to be adapted to face downwardly toward the printed circuit board in the vertical direction; wherein said internal cavity is configured to be adapted to receive, during said overmolding process, a metallic sliding block, which is not a part of the electrical connector while being adapted to press the inner insulator in said transverse direction; wherein the outer insulator is inherently adhered and attached upon the inner insulator due to the overmolding process.

2. The electrical connector as claimed in claim 1, wherein the outer insulator includes a plurality of ribs to divide the internal cavity into a plurality of units.

3. The electrical connector as claimed in claim 1, wherein the internal cavity is smaller than inner insulator in at least either the vertical direction or the longitudinal direction.

4. The electrical connector as claimed in claim 1, wherein the inner insulator forms a positioning groove facing the internal cavity in the transverse direction for receiving a corresponding protrusion formed on the sliding block so as to restrain a relative movement of the inner insulator along the longitudinal direction during the overmolding process.

5. The electrical connector as claimed in claim 4, wherein said positioning groove has a tapered structure thereof.

6. The electrical connector as claimed in claim 1, wherein the inner insulator and the outer insulator commonly form an insulative housing which is categorized with a lower base and an upper tongue extending upwardly from the base in the vertical direction.

7. The electrical connector as claimed in claim 6, wherein the tongue forms a pair of mating surfaces opposite to each other in the transverse direction, and said contacting sections of all the contacts are exposed upon a mating area formed on only one of said pair of mating surfaces, and the inner insulator is located between the internal cavity and said only one of said pair of mating surfaces in the transverse direction.

8. The electrical connector as claimed in claim 1, wherein in the contact module, the inner insulator forms a plurality of positioning holes communicatively corresponding to the contacts, and said positioning holes are filled with material of the outer insulator.

9. The electrical connector as claimed in claim 8, wherein said positioning holes are aligned with the corresponding contacts, respectively, in the transverse direction.

10. A method of making an electrical connector, comprising steps of:

providing a contact module with a plurality of contacts integrally formed within an inner insulator via an insert-molding process, wherein said contacts are arranged in one row along a longitudinal direction, each of said contacts includes an upper contacting section, a lower tail section and a middle retaining section therebetween in a vertical direction perpendicular to said longitudinal direction, and the contacting section is exposed toward an exterior in a transverse direction perpendicular to both longitudinal direction and the vertical direction;

applying an outer insulator upon the inner insulator via an overmolding process to enclose said contact module to form the complete electrical connector wherein the outer insulator forms two opposite mating surfaces in the transverse direction and said contacting sections of all the contacts are exposed to the exterior on only one of said two opposite mating surfaces; and forming an internal cavity by removing a metallic sliding block from the connector after the overmolding process; wherein said internal cavity communicates with the exterior only downwardly in the vertical direction, and the inner insulator is located between the internal cavity and said only one of said two opposite mating surfaces in the transverse direction; wherein the outer insulator is inherently adhered and attached upon the inner insulator due to the overmolding process.

11. The method of making the electrical connector as claimed in claim 10, wherein said sliding block is moveable, in the vertical direction, along a corresponding sliding slot formed in a mold used in said overmolding process.

* * * * *